US010759565B2

(12) United States Patent
Chen

(10) Patent No.: US 10,759,565 B2
(45) Date of Patent: Sep. 1, 2020

(54) BEVERAGE CONTAINER

(71) Applicants: Tai-Liang Chen, Kaohsiung (TW); Fang-Yuan Lee, Taipei (TW)

(72) Inventor: Tai-Liang Chen, Kaohsiung (TW)

(73) Assignees: Tai-Liang Chen, Kaohsiung (TW); Fang-Yuan Lee, Taipei (TW)

( * ) Notice: Subject to any disclaimer, the term of this patent is extended or adjusted under 35 U.S.C. 154(b) by 0 days.

(21) Appl. No.: 16/270,126

(22) Filed: Feb. 7, 2019

(65) Prior Publication Data

US 2020/0071028 A1 Mar. 5, 2020

(30) Foreign Application Priority Data

Aug. 30, 2018 (TW) ..... 107130268 A

(51) Int. Cl.

| | |
|---|---|
| ***A47G 19/22*** | (2006.01) |
| ***B65D 25/38*** | (2006.01) |
| ***B65D 25/04*** | (2006.01) |
| ***B65D 53/08*** | (2006.01) |

(52) U.S. Cl.

CPC ..... *B65D 25/38* (2013.01); *A47G 19/2272* (2013.01); *B65D 25/04* (2013.01); *B65D 53/08* (2013.01)

(58) Field of Classification Search

CPC .... B65D 77/286; B65D 77/283; B65D 77/28; B65D 25/38; B65D 53/08; A47G 19/2272

USPC ..... 220/710

See application file for complete search history.

(56) References Cited

U.S. PATENT DOCUMENTS 3,298,591 A * 1/1967 Cohen ..... B65D 77/30 229/103.1

3,558,033 A * 1/1971 Leeds ..... A47G 19/2266 229/103.1

5,823,422 A * 10/1998 Collier ..... B65D 77/283 229/103.1

* cited by examiner

*Primary Examiner* — Stephen J Castellano

(74) *Attorney, Agent, or Firm* — Muncy, Geissler, Olds & Lowe, P.C.

(57) ABSTRACT

A beverage container including a main body, a cover and a sucking unit is provided. The main body includes an interior space for containing a beverage and a top wall having an inner rim which defines an opening communicated with the interior space. The cover removably seals the opening. The sucking unit is mounted within the main body adjacent to the opening and includes a partition wall extending into the interior space to define a channel which fluidly communicates the opening with the interior space. The sucking unit is configured to enable a person to suck up the beverage contained in the interior space through the channel and the opening after removal of the cover.

9 Claims, 10 Drawing Sheets

BEVERAGE CONTAINER

CROSS-REFERENCE TO RELATED APPLICATION

This application claims priority of Taiwanese Invention Patent Application No. 107130268, filed on Aug. 30, 2018.

FIELD

The disclosure relates to a container, and more particularly to a beverage container.

BACKGROUND

Referring to FIG. 1, a conventional beverage container 61 includes a drinking straw 63 that is packaged in a straw wrapper 62 and that is used to perforate through the beverage container 61 for accessing and drinking beverage therein. The straw wrapper 62 is conveniently glued to an outer surface of the beverage container 61, thereby alleviating a need to seek out the drinking straw 63 when needed for accessing and drinking the beverage. However, the straw wrapper 62 is undesirable as it contributes to natural resource consumption (such as plastic or paper), and becomes garbage after use. Although the beverage container 61, the straw wrapper 62 and the drinking straw 63 can be recycled after use, they need to be separated from one another beforehand, resulting in a relatively complicated recycling process. Sometimes, the drinking straw 63, together with the straw wrapper 62, may be accidentally torn apart from the beverage container 61 and be lost during transportation. Under this situation, the beverage container 61 needs to be cut or be pierced to enable a person to access and drink the beverage contained therein. Moreover, in the case in which the beverage container 61 is pierced, it would be difficult to suck up the portion of beverage at the bottom of the beverage container 61 for drinking.

SUMMARY

Therefore, an object of the disclosure is to provide a beverage container which enables sucking up the beverage at the bottom of the beverage container without the need of a drinking straw.

Accordingly, the beverage container of the disclosure comprises a main body, a cover, and a sucking unit. The main body includes a bottom wall, a surrounding wall extending upwardly from the bottom wall, atop wall connected to the surrounding wall, and an interior space for containing the beverage. The top wall has an inner rim which defines an opening communicated with the interior space. The cover removably seals the opening. The sucking unit is mounted within the main body adjacent to the opening and includes a partition wall extending into the interior space to define a channel which fluidly communicates the opening with the interior space. The sucking unit is configured to enable a person to suck up the beverage contained in the interior space through the channel and the opening after removal of the cover.

BRIEF DESCRIPTION OF THE DRAWINGS

Other features and advantages of the disclosure will become apparent in the following detailed description of the embodiments and variations with reference to the accompanying drawings, of which.

DETAILED DESCRIPTION

Figure 1:
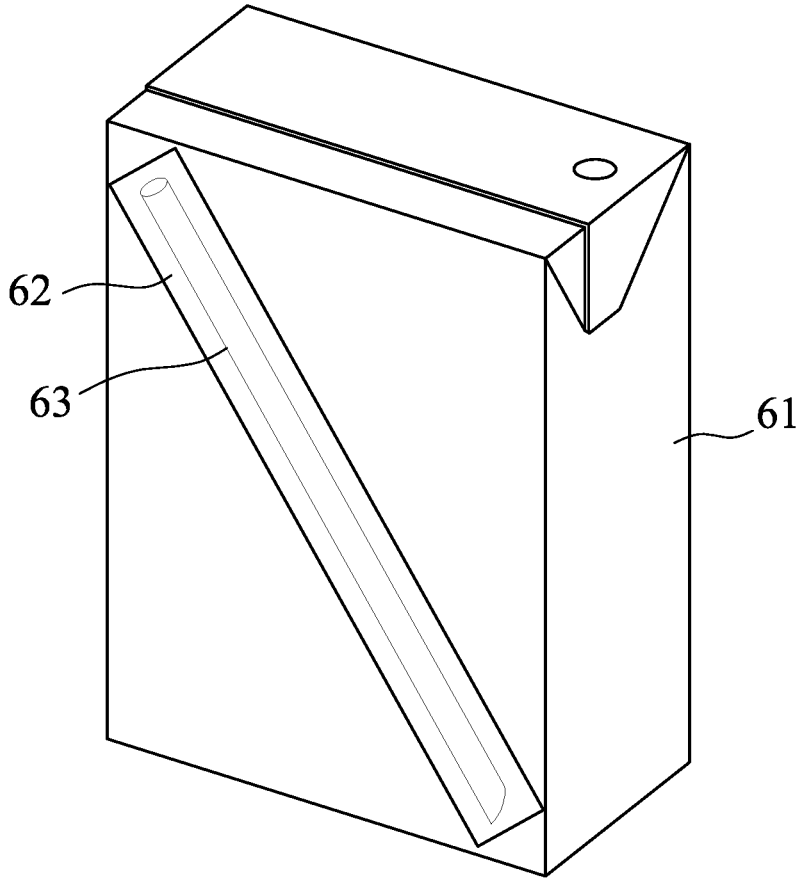
FIG.1 PRIOR ART
FIG. 1 is a perspective view of a conventional beverage container.

Before the disclosure is described in greater detail, it should be noted that where considered appropriate, reference numerals have been repeated among the figures to indicate corresponding or analogous elements, which may optionally have similar characteristics.

Figure 2:
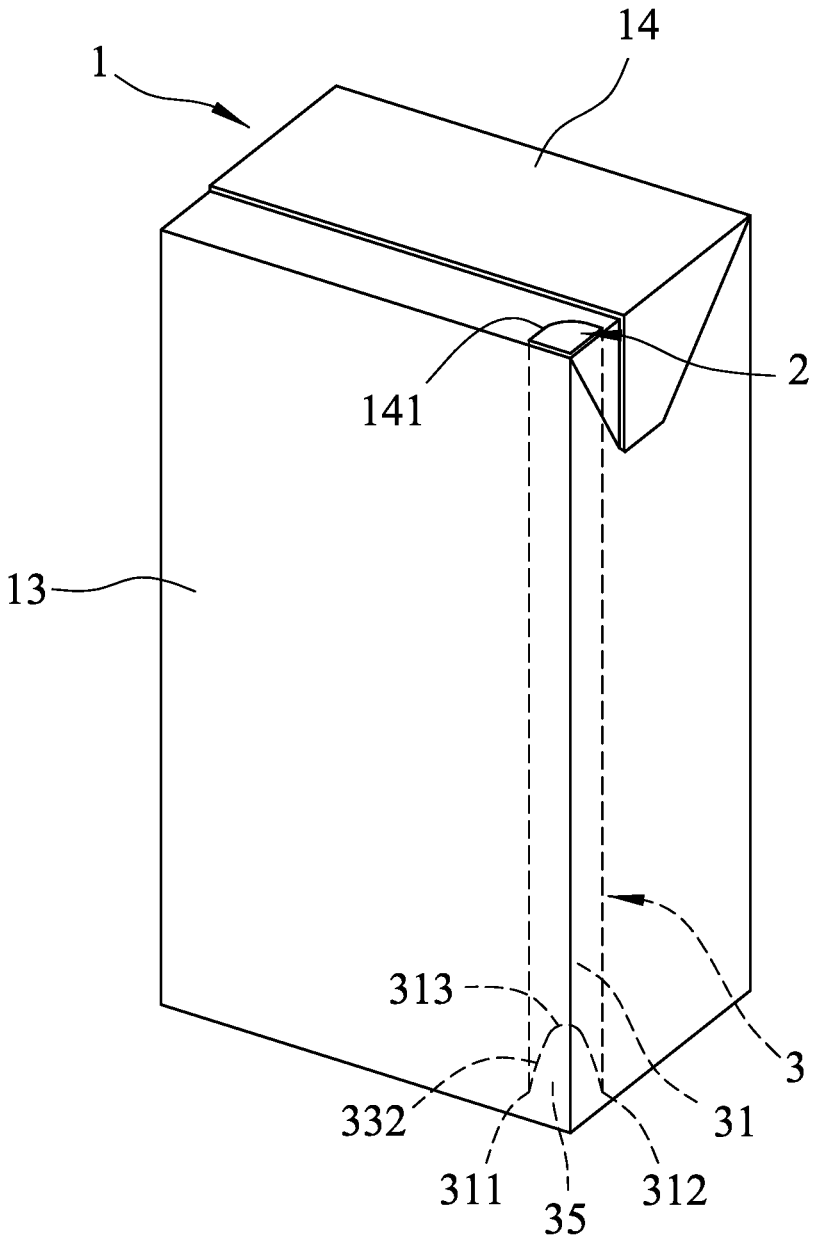
FIG. 2 is a perspective view of a beverage container according to a first embodiment of the disclosure.
Figure 3:
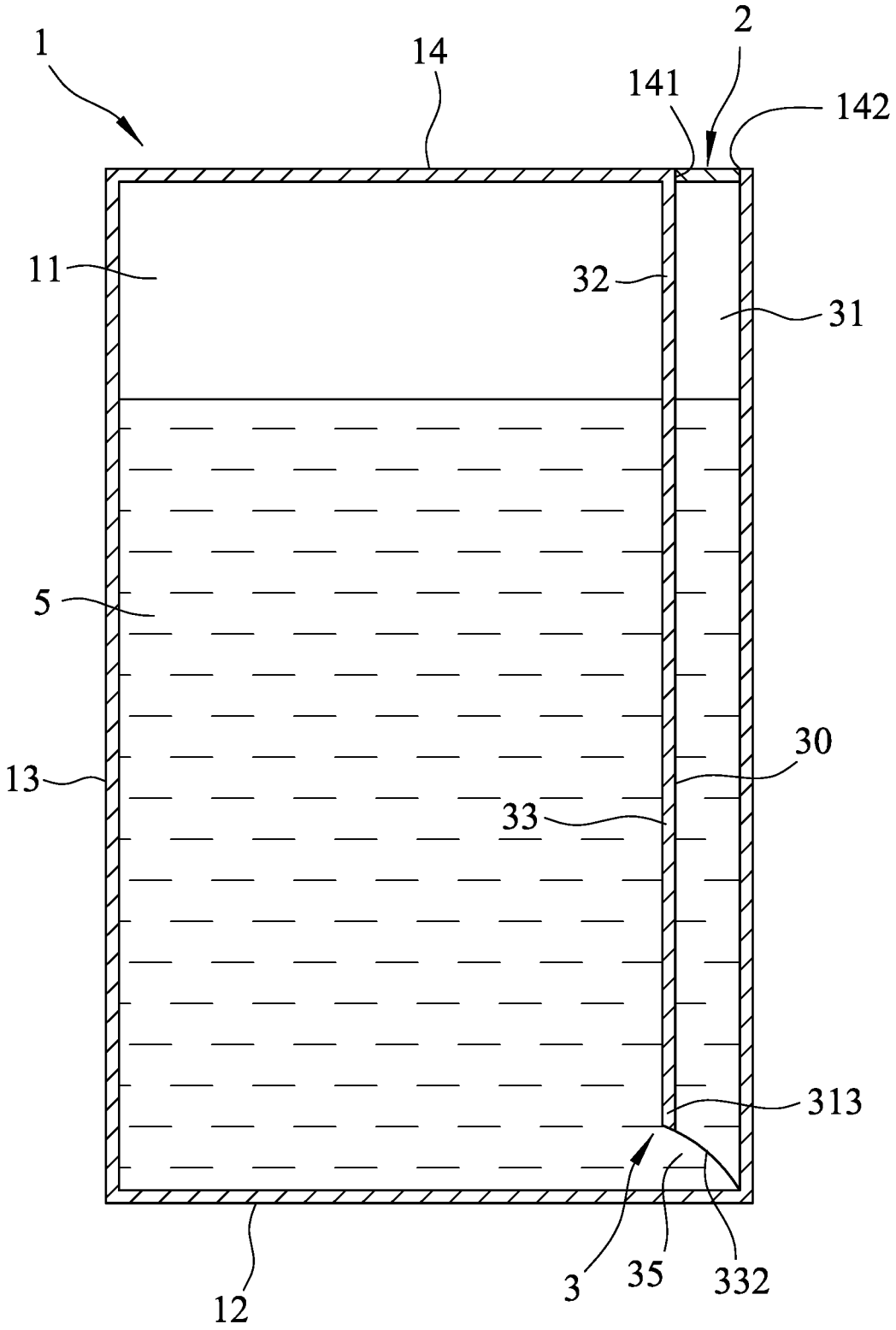
FIG. 3 is a side sectional view of the first embodiment.

Referring to FIGS. 2 and 3, the beverage container according to the first embodiment of the disclosure includes a main body 1, a cover 2, and a sucking unit 3. The main body 1 includes a bottom wall 12, a surrounding wall 13 extending upwardly from the bottom wall 12, a top wall 14 connected to a top end of the surrounding wall 13, and an interior space 11 for containing the beverage 5. The top wall 14 has an inner rim 141 defining an opening 142 communicated with the interior space 11. The cover 2 removably seals the opening 142. The sucking unit 3 is mounted within the main body 1 adjacent to the opening 142 and includes a partition wall 30 extending from the inner rim 141 into the interior space 11 to define a channel 31 which fluidly communicates the opening 142 and the interior space 11. The sucking unit 3 is configured to enable a person to suck up the beverage 5 contained in the interior space 11 through the channel 31 and the opening 142 after removal of the cover 2. The partition wall 30 has an upper section 32 connected integrally to the top wall 14, a lower section 33 extending from the upper section 32 toward the bottom wall 12, and a curved bottom edge 332 which defines a passage hole 35 with the bottom wall 12. The passage hole 35 fluidly communicates the interior space 11 with the channel 31.

In this embodiment, the cover 2 is disposed inside the opening 142 and is connected detachably to the inner rim 141 to seal the opening 142. To drink the beverage 5 contained in the beverage container, a person only needs to apply a pressing force on the cover 2 such that the cover 2 breaks apart from the inner rim 141, thereby uncovering the opening 142. The beverage 5 can then be sucked up directly through the opening 142 without the need for a drinking straw.

Further, in this embodiment, the partition wall 30 is integrally connected to two adjacent sides of the surrounding wall 13 and cooperates with the surrounding wall 13 to define the channel 31. In other embodiments, the surrounding wall 13 may be tubular in shape to define the channel 31 therein.

In this embodiment, the bottom edge 332 of the partition wall 30 includes opposite first and second ends 311, 312 connected to the surrounding wall 13 and disposed proximate to the bottom wall 12, and a middle portion 313 between the first end 311 and the second end 312 and spaced apart from the bottom wall 12, thus facilitating sucking up the portion of beverage 5 at the bottom of the main body 1. The bottom edge 332 is curved downwardly from the middle portion 313 to the first end 311 and the second end 312, respectively. In other embodiments, the bottom edge 332 may include linear sections extending obliquely from the middle portion 313 to the first and second ends 311, 312, respectively.

Figure 4:
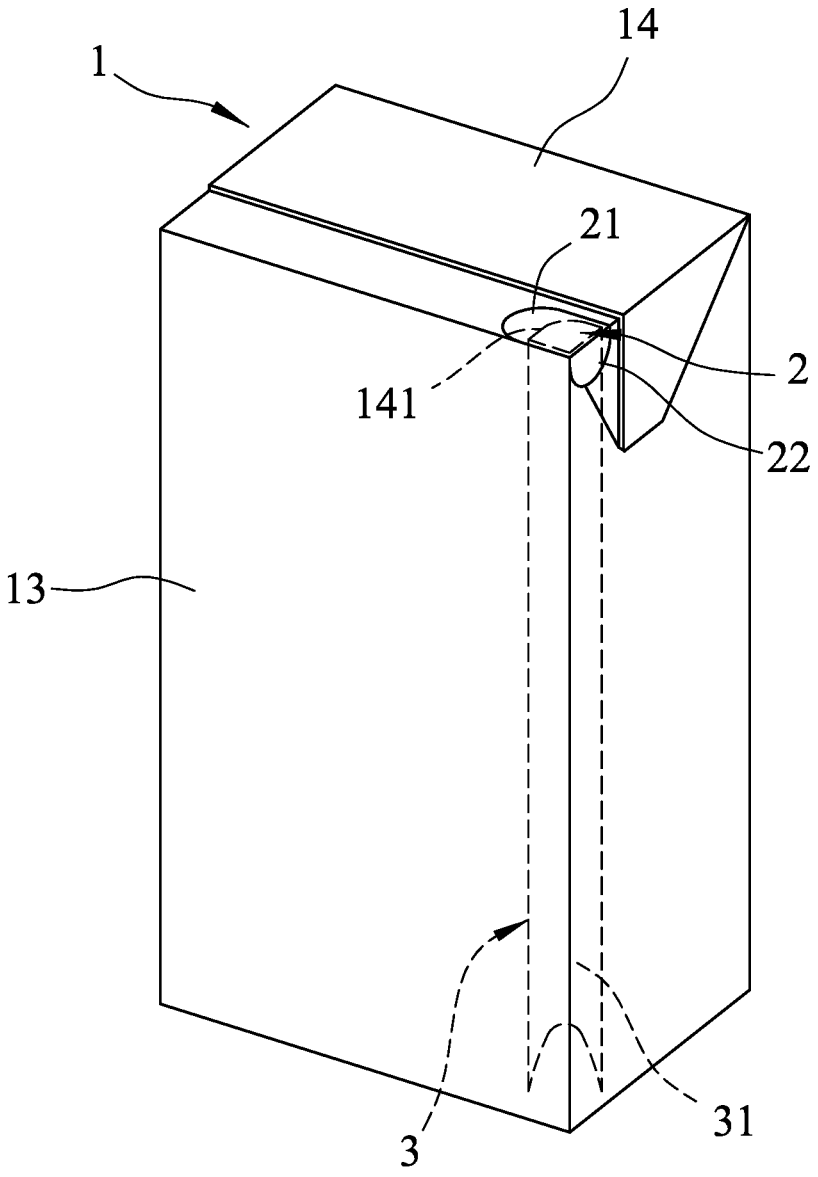
FIG. 4 is a perspective view of a second embodiment of the disclosure.
Figure 5:
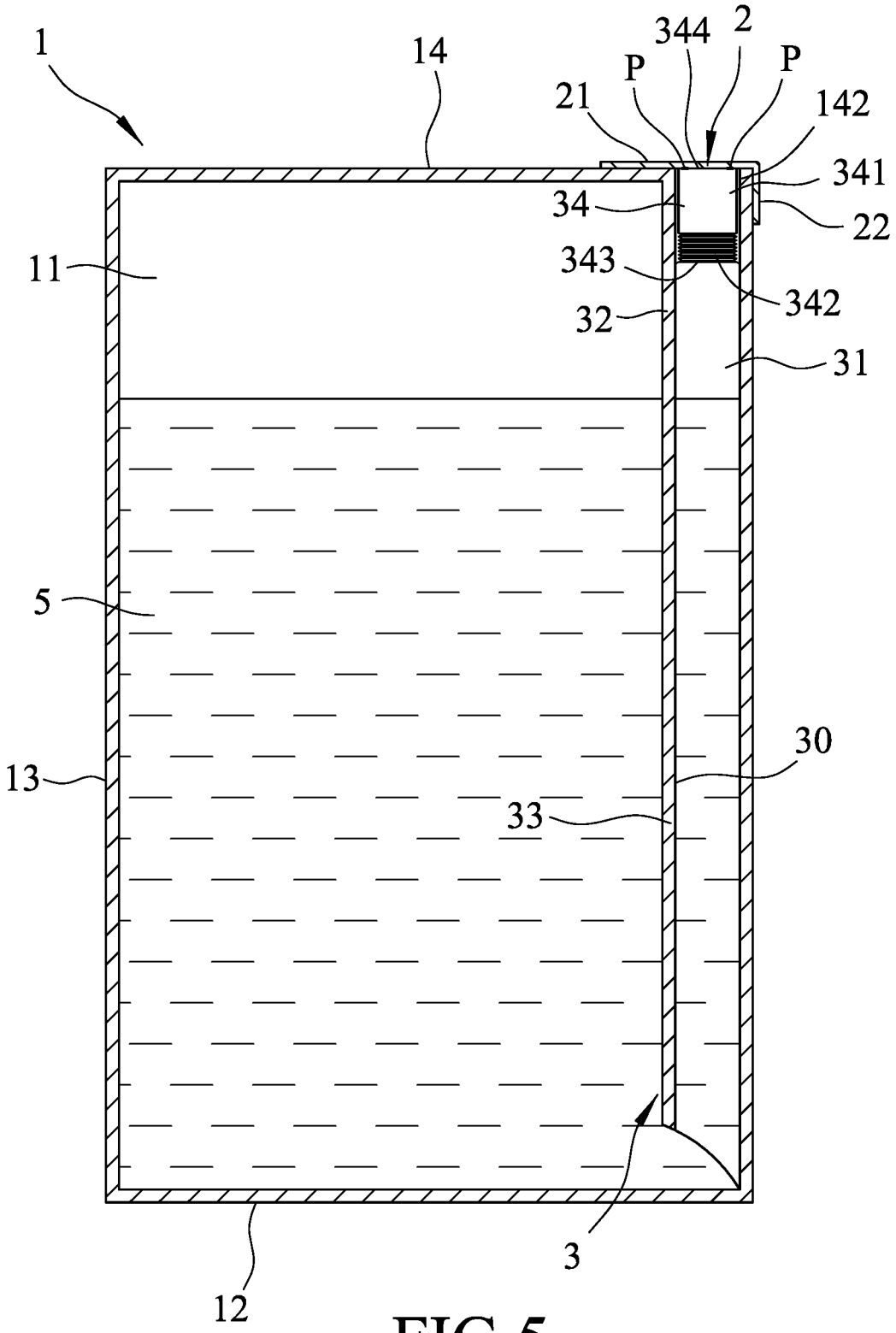
FIG. 5 is a side sectional view of the second embodiment.
Figure 6:
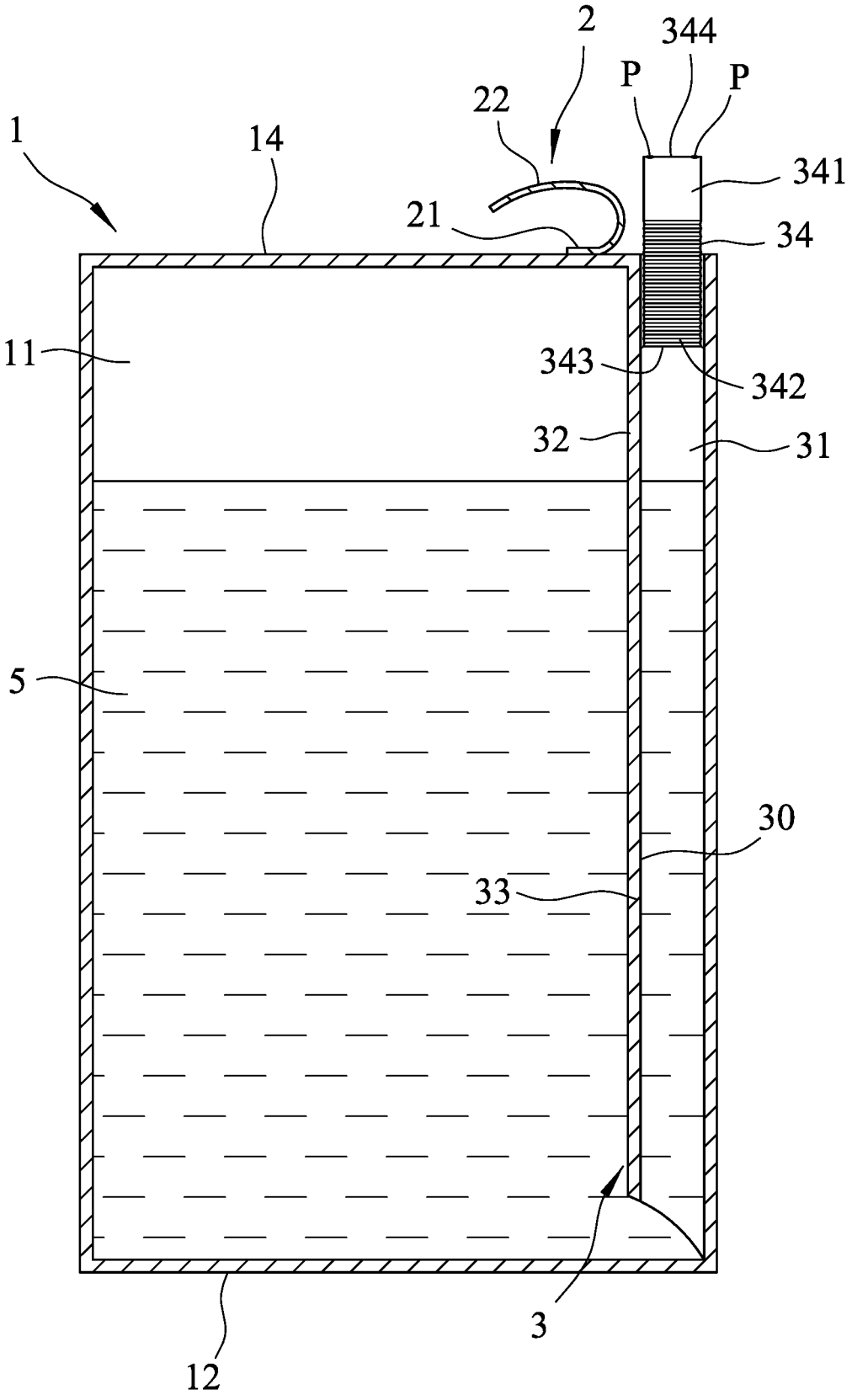
FIG. 6 is another side sectional view of the second embodiment, illustrating a drinking straw extending outwardly from an opening of the beverage container when a cover thereof is lifted.

Referring to FIGS. 4 to 6, in the beverage container according to the second embodiment of the disclosure, the sucking unit 3 further includes a drinking straw 34 received in the channel 31 and disposed adjacent to the opening 142 to be concealed by the cover 2. The drinking straw 34 has an upper section 341 and a telescopic lower section 342 connected to the upper section 341. A lower end 343 of the drinking straw 34 is fixedly secured in the channel 31, such as by gluing to the partition wall 30. The telescopic lower section 342 of the drinking straw 34 is compressible to retract the drinking straw 34 in the channel 31 before the cover 2 is removed, and is expandable to permit extension of the upper section 341 of the drinking straw 34 out of the opening 142 when the cover 2 is removed from the opening 142. The cover 2 is attached to the top wall 14 of the main body 1 to sealingly cover the opening 142, and includes a lifting tab end 22 extending to the surrounding wall 13 and operable to lift the cover 2 so as to expose the opening 142, and a fixing end 21 opposite to the lifting tab end 22 and secured to the top wall 14. The drinking straw 34 has an upper end 344 adhered mildly and detachably to the cover 2 at several adhering points (P) using a weak adhesive in such a manner that when the cover 2 is being lifted to expose the opening 142, the upper section 341 of the drinking straw 34 would be pulled upwardly by the cover 2 to enable extension of the upper section 341 of the drinking straw 34 out of the opening 142. The upper end 344 of the drinking straw 34 would then be detached from the cover 2 when the lifting operation continues and the cover 2 is bent to fully expose the opening 142.

Referring to FIG. 5, in this embodiment, before the beverage container is opened, the telescopic lower section 342 of the drinking straw 34 is in a compressed state such that the drinking straw 34 is entirely received within the channel 31 and concealed by the cover 2.

To drink the beverage 5 contained in the beverage container, a person only needs to lift the lifting tab end 22 toward the fixing end 21 of the cover 2. At this time, due to the presence of the adhering points (P), the upper section 341 of the drinking straw 34 will be pulled upwardly by the cover 2 to extend out of the opening 142, with the telescopic lower section 342 expanding and the lower end 343 of the drinking straw 34 fixed to the partition wall 30. Manual operation for pulling out the drinking straw 34 is not necessary, thus providing enhanced convenience and sanitation in serving the beverage 5.

Figure 7:
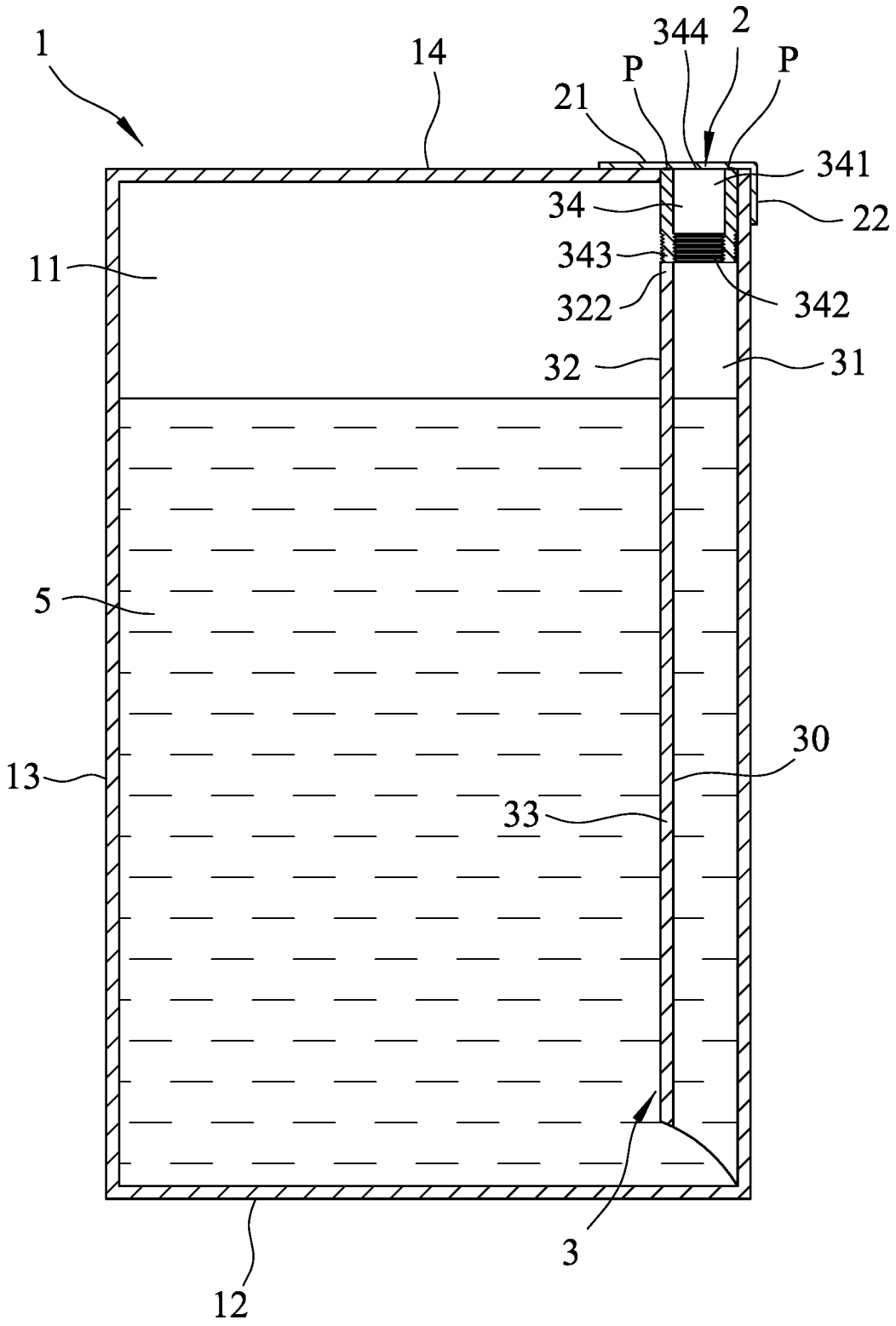
FIG. 7 is a side sectional view of a third embodiment of the disclosure.
Figure 8:
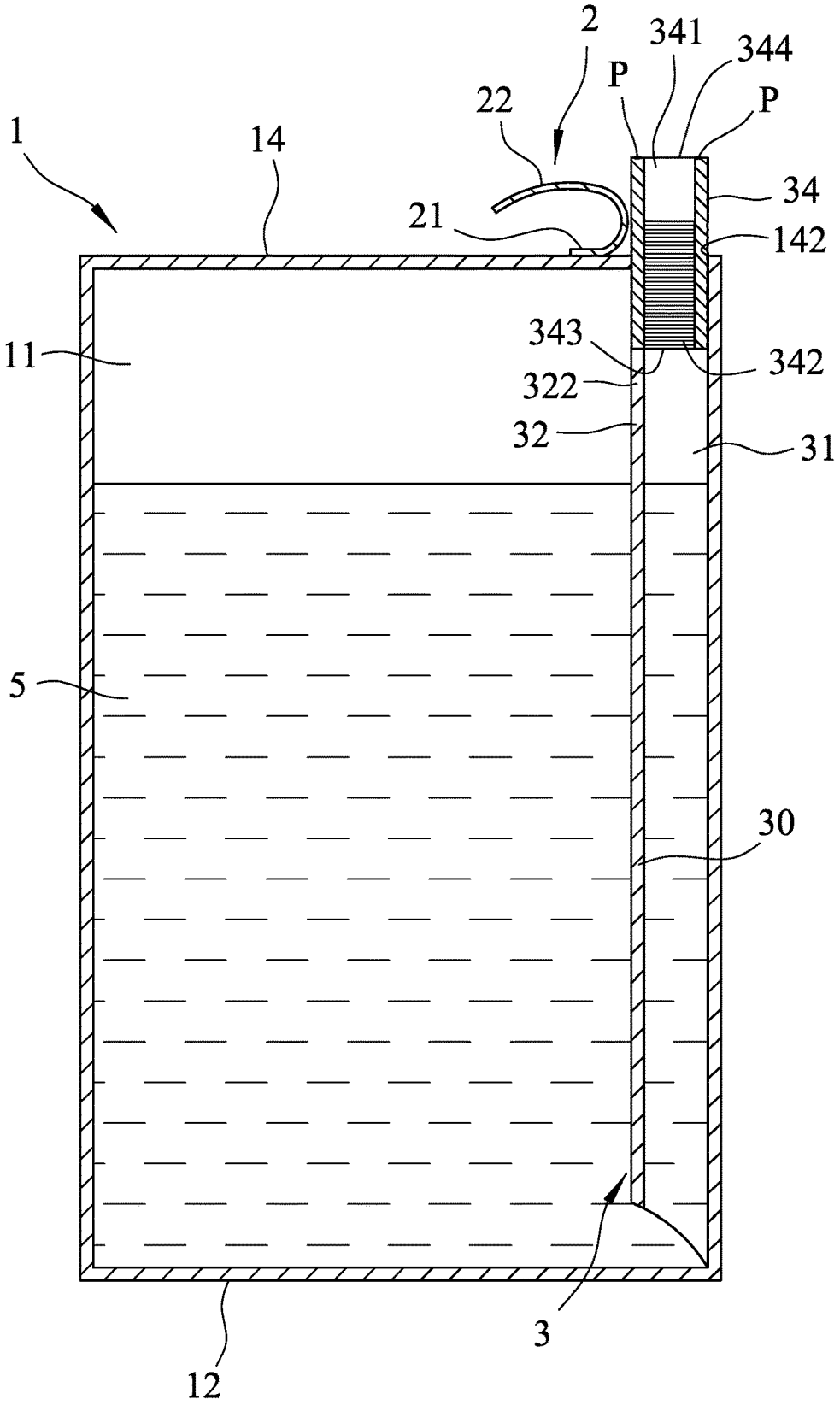
FIG. 8 is another side sectional view of the third embodiment, illustrating the drinking straw extending outwardly from the opening of the beverage container when the cover is lifted.

Referring to FIGS. 7 and 8, in the beverage container according to the third embodiment of the disclosure, the partition wall 30 does not extend to the top wall 14, and the drinking straw 34 is disposed between the partition wall 30 and the opening 142 to fluidly communicate the channel 31 with the opening 142. The lower end 343 of the drinking straw 34 is disposed on and secured to a top edge 322 of the partition wall 30. The telescopic lower section 342 of the drinking straw 34 is retracted before the cover 2 is removed and is extendible to permit extension of the upper section 341 of the drinking straw 34 out of the opening 142 when the cover 2 is lifted or removed to expose the opening 142. As with the previous embodiment, when the lifting tab end 22 of the cover 2 is being lifted away from the surrounding wall 13 and toward the fixing end 21, the upper section 341 of the drinking straw 34 would be pulled upwardly by the cover 2, due to the presence of the adhering points (P), to enable extension of the upper section 341 of the drinking straw 34 out of the opening 142, as shown in FIG. 8.

Figure 9:
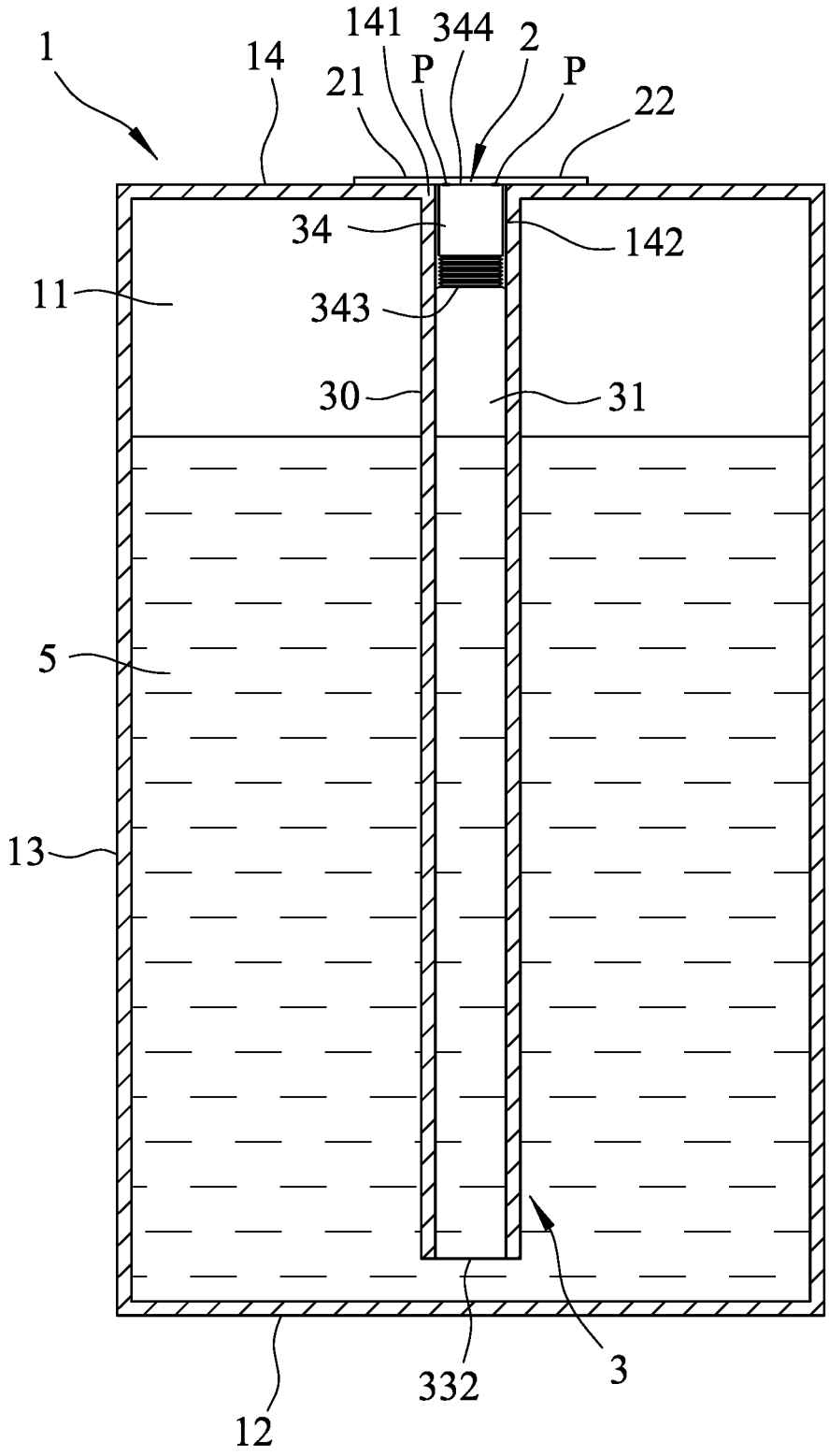
FIG. 9 is a side sectional view of a fourth embodiment of the disclosure.

Referring to FIG. 9, in the beverage container according to the fourth embodiment of the disclosure, the opening 142 is formed substantially at a central portion of the top wall 14. The partition wall 30 extends integrally from the inner rim 141 of the top wall 14 toward the bottom wall 12 and is tubular in shape to define the channel 31 therein. Furthermore, the bottom edge 332 of the partition wall 30 extends in a plane parallel to the bottom wall 12 and is spaced apart from the bottom wall 12. In addition, the fixing end 21 and the lifting tab end 22 of the cover 2 are both attached to the top wall 14 to sealingly cover the opening 142. The drinking straw 34, with its lower end 343 secured to the partition wall 30 and upper end 344 mildly and detachably adhered to the cover 2 at the adhering points (P), can be pulled out of the channel 31 by the cover 2 before detaching from the cover 2 when the lifting tab end 22 of the cover 2 is being lifted to expose the opening 142, thus providing enhanced convenience for a person to drink the beverage 5 contained in the beverage container.

Figure 10:
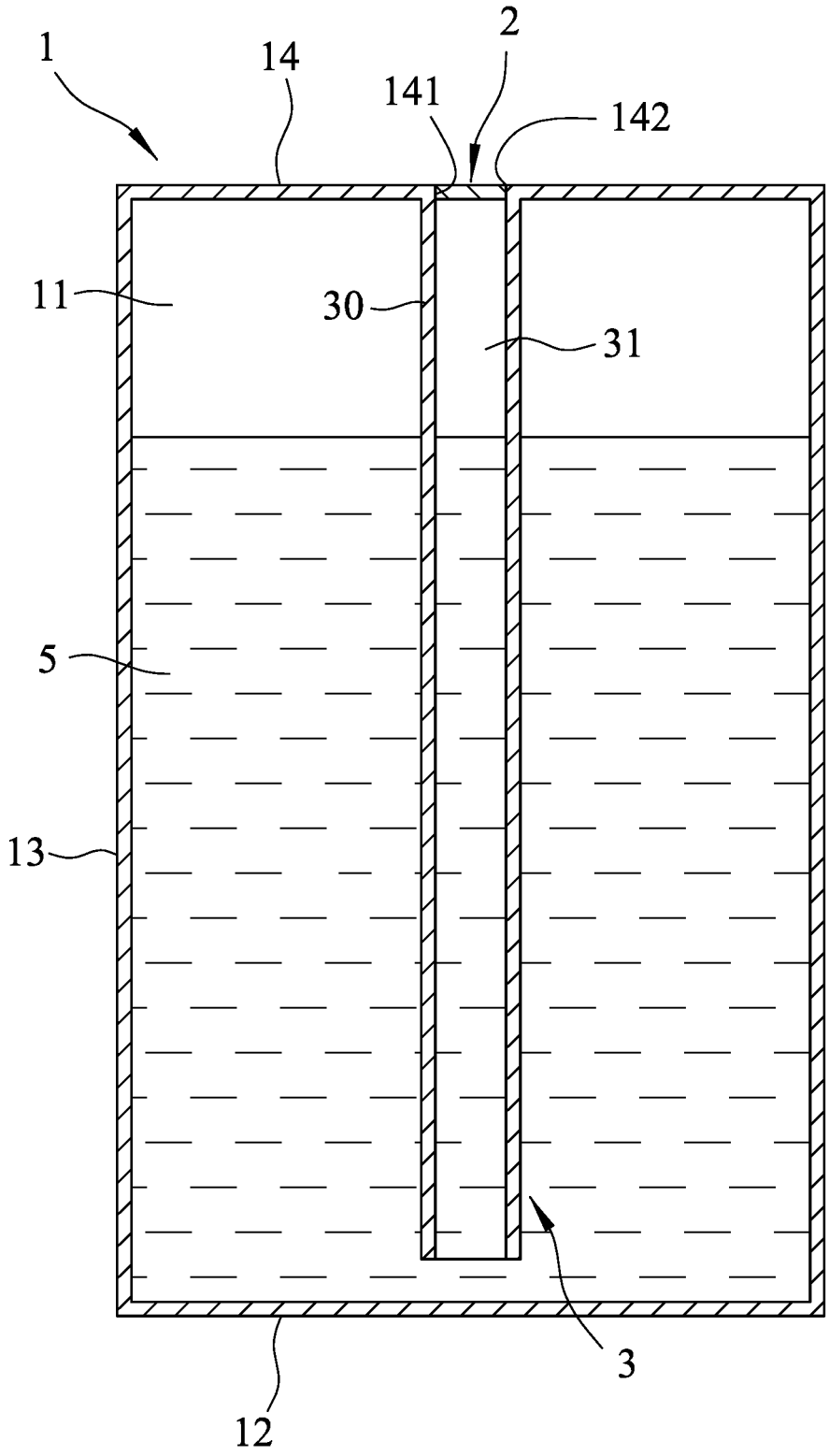
FIG. 10 is a side sectional view of a fifth embodiment of the disclosure.

Referring to FIG. 10, in the beverage container according to the fifth embodiment of the disclosure, the drinking straw 34 is obviated and the cover 2 is disposed inside the opening 142 and is connected detachably to the inner rim 141 to seal the opening 142.

Accordingly, with the sucking unit 3 mounted inside the main body 1, a person needs only remove the cover 2 to drink the beverage 5 contained in the beverage container without the need for inserting a drinking straw, thus providing enhanced convenience in drinking, producing reduced amount of garbage and facilitating the recycling process.

In the description above, for the purposes of explanation, numerous specific details have been set forth in order to provide a thorough understanding of the embodiment and variation. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiment and variation, it is understood that this disclosure is not limited to the disclosed embodiment and variation but is intended to cover various arrangements included within the spirit and scope of the broadest interpretation so as to encompass all such modifications and equivalent arrangements.

What is claimed is:

1. A beverage container comprising:

a main body including a bottom wall, a surrounding wall extending upwardly from the bottom wall, a top wall connected to the surrounding wall, and an interior space for containing a beverage, the top wall having an inner rim which defines an opening communicated with said interior space;

a cover to removably seal said opening; and a sucking unit mounted within said main body adjacent to said opening and including a partition wall extending into said interior space to define a channel which fluidly communicates said opening with said interior space, said sucking unit being configured to enable a person to suck up the beverage contained in said interior space through said channel and said opening after removal of said cover;

wherein said partition wall is connected integrally to said surrounding wall and cooperates with said surrounding wall of to define said channel;

wherein said sucking unit further includes a drinking straw disposed between said partition wall and said opening to fluidly communicate said channel with said opening; and wherein said drinking straw has an upper section and a telescopic lower section with a bottom end disposed securely on a top edge of said partition wall.

2. The beverage container according to claim 1, wherein said partition wall has a bottom edge which includes opposite first and second ends connected to said surrounding wall and disposed proximate to said bottom wall, and a middle portion between said first and second ends and spaced apart from said bottom wall such that a passage hole is defined between said bottom edge of said partition wall and said bottom wall to fluidly communicate said interior space with said channel.

3. The beverage container according to claim 2, wherein said bottom edge is curved downwardly from said middle portion to said first and second ends, respectively.

4. The beverage container according to claim 2, wherein said bottom edge extends obliquely from said middle portion to said first and second ends, respectively.

5. The beverage container according to claim 1, wherein said cover includes a lifting tab end operable to lift said cover so as to expose said opening, said drinking straw having an upper end adhered detachably to said cover in such a manner that when said cover is lifted to expose said opening, said upper section of said drinking straw is pulled upwardly by said cover to extend out of said opening before detaching from said cover.

6. The beverage container according to claim 1, wherein said cover includes a fixing end secured to said top wall and a lifting tab end opposite to said fixing end and operable to lift said cover so as to expose said opening.

7. The beverage container according to claim 6, wherein said lifting tab end extends to said surrounding wall.

8. The beverage container according to claim 1, wherein said partition wall has a bottom edge which extends in a plane parallel to said bottom wall and which is spaced apart from said bottom wall.

9. The beverage container according to claim 1, wherein said cover is disposed in said opening and is connected detachably to said inner rim of said top wall to seal said opening.

* * * * *